US010858915B2

(12) United States Patent
Assaad et al.

(10) Patent No.: US 10,858,915 B2
(45) Date of Patent: Dec. 8, 2020

(54) REDUCING SWAB PRESSURE GENERATED BEHIND A WELL LINER EXPANSION CONE

(71) Applicant: SHELL OIL COMPANY, Houston, TX (US)

(72) Inventors: Wissam Assaad, Rijswijk (NL); Djurre Hans Zijsling, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 56 days.

(21) Appl. No.: 16/336,423

(22) PCT Filed: Sep. 11, 2017

(86) PCT No.: PCT/EP2017/072676
§ 371 (c)(1),
(2) Date: Mar. 25, 2019

(87) PCT Pub. No.: WO2018/059913
PCT Pub. Date: Apr. 5, 2018

(65) Prior Publication Data

US 2019/0257179 A1 Aug. 22, 2019

(30) Foreign Application Priority Data

Sep. 27, 2016 (EP) ..... 16190859

(51) Int. Cl.
*E21B 43/10* (2006.01)

(52) U.S. Cl.
CPC ..... *E21B 43/105* (2013.01)

(58) Field of Classification Search
CPC ..... E21B 43/105
See application file for complete search history.

(56) References Cited

U.S. PATENT DOCUMENTS 6,557,640 B1 5/2003 Cook et al.
6,631,760 B2 * 10/2003 Cook ..... E21B 29/10 166/242.6
2004/0055759 A1 3/2004 Sivley, IV
(Continued)

FOREIGN PATENT DOCUMENTS

WO 03006788 A1 1/2003

OTHER PUBLICATIONS

International Search Report and Written Opinion received for PCT Patent Application No. PCT/EP2017/072676, dated Mar. 5, 2018, 16 pages.

*Primary Examiner* — D. Andrews

(57) ABSTRACT

A tubular pull string assembly (5, 5A) may be used to pull up an expansion mandrel (1) through an area of overlap (2) between an upper section of a well liner (3) expanded by the expansion mandrel and a lower section of a previously installed liner (4). The tubular pull string assembly may be provided with at least one flow port (6), through which fluid is permitted to flow from the exterior (7) to the interior (8) of the tubular pull string assembly during pop out of the expansion mandrel from the area of overlap. In addition thereto, or instead thereof, the expansion mandrel may be provided with a streamlined tail (1A) section having an inwardly tapered outer surface (11) that intersects a longitudinal axis of the expansion mandrel at a sharp angle. The sharp angle can be less than 20 degrees. The tail section can have a length of at least several centimeters.

14 Claims, 4 Drawing Sheets

(56) References Cited

U.S. PATENT DOCUMENTS

| | | | | |
|---|---|---|---|---|
| 2012/0061097 | A1* | 3/2012 | O'Connor | E21B 43/103 166/381 |
| 2012/0152567 | A1* | 6/2012 | Whiddon | E21B 23/02 166/382 |
| 2012/0211222 | A1 | 8/2012 | Leighton et al. | |
| 2013/0269956 | A1 | 10/2013 | Yee | |
| 2015/0247388 | A1 | 9/2015 | Di Crescenzo et al. | |

* cited by examiner

PRIOR ART CONE

PRIOR ART CONE

REDUCING SWAB PRESSURE GENERATED BEHIND A WELL LINER EXPANSION CONE

CROSS REFERENCE TO EARLIER APPLICATION

The present application is a National Stage (§ 371) application of PCT/EP2017/072676, filed Sep. 11, 2017, which claims priority benefits of European Application No. 16190859.5, filed Sep. 27, 2016, the disclosure of which is incorporated by reference herein.

FIELD OF THE INVENTION

The invention relates to systems and methods for expanding at least an upper section of a well liner configured within a lower section of a previously installed liner. The invention also relates to an expansion mandrel for expanding of a well liner inserted at least partially inside a previously installed liner.

BACKGROUND OF THE INVENTION

In the field of drilling and completing of wellbores in the earth, well liners are commonly configured partly overlapping with a lower section of a previously installed liner. Well liners may be installed in a telescoping arrangement whereby the inner diameter of the well liner is materially smaller than that of the previously installed liner, or expanded to essentially or nearly match the inner diameter of the previously installed liner to create a so-called "mono-diameter" string of liners.

A downhole liner expansion method and system is disclosed in publication No. US 2015/247388 A1. In this expansion system a well liner is expanded downhole by pulling an expansion cone through the liner by means of a drill string assembly. During the expansion the expanded lower liner is suspended below a previously installed upper liner and the expansion process comprises two phases:

(1) an initial single liner expansion phase during which the lower liner is expanded against a non-cured cement layer which has no influence on the expansion force; and (2) a subsequent overlap expansion phase, during which the upper section of the lower liner is expanded against the lower section of a previously installed upper liner, which is surrounded by a cured cement and the formation, so that the expansion force is increased tremendously during this overlap expansion phase.

The force amplitude is influenced by the mechanical properties of the previously installed upper liner and of the surrounding cement and earth formation. The increase in expansion force may lead to an additional stretch in the drill string, the stretch of the drill string is directly proportional to the expansion force and may exceed 10 m.

When the cone finishes its stroke in the overlap expansion region, it pops out and a swab pressure is generated in the region below the cone. If the difference between outer and inner pressure applied on the lower liner exceeds its collapse rating, the lower liner collapses and work in the current hole must be stopped.

A theoretical model has been built to predict the swab pressure during cone pop out. The theoretical model shows that the cone kinematics leads to fluid flow through the drill pipe and around the cone, and expansion of fluid volume in the region below the cone in order to fill the volume initially occupied by the cone. The flow of fluid through the drill pipe and around the cone undergoes a pressure drop from upstream to downstream.

The pressure drop has two components: (I) frictional pressure drop (II) change in flow cross-sectional area pressure drop. Since the flow cross-sectional area through the drill pipe is constant, the frictional pressure drop is the dominant, it depends on pipe roughness and it cannot be changed.

In fluid mechanics, (I) is called a major loss while (II) is called a minor loss. Since the flow around the cone passes through different cross-sectional areas and high fluid velocities can be reached at the smallest cross-sectional areas, the pressure loss due to change in cross-sectional area is the dominant. A variation of fluid velocity in longitudinal direction in a region below the cone, where the velocity is high at boundaries and low at the middle, generates a recirculation zone. The length of the recirculation zone influences the pressure drop of fluid flowing from upstream to downstream.

There are two current solutions:

First, an elevated fluid pressure can be maintained below the cone this may result in fracturing the formation if the applied elevated fluid pressure exceeds the formation fracturing pressure. The aforementioned consequence can be avoided by installing a clad plug at the bottom of liner but its installation requires additional control effort and to be drilled during drilling the next well section.

Second, the clearance between the host pipe and cone may be increased by reducing the cone size.

This second solution will, however, lead to smaller liner size in the next well section which contradicts the concept of creating a non-telescoping Mono-Diameter (MOD) well.

There is a need for an improved method and system for reducing a swab pressure generated behind a liner expansion cone that overcome drawbacks of the known solutions.

SUMMARY OF THE INVENTION

In accordance with first aspects of the invention there is provided a method of expanding at least an upper section of a well liner configured within a lower section of a previously installed liner, the method comprising:

pulling an expansion mandrel up through the well liner, in an area of overlap between the well liner and the previously installed liner, whereby:

providing an expansion mandrel with a streamlined tail section having an inwardly tapered outer surface that intersects a longitudinal axis of the expansion mandrel at a sharp angle which is less than 20 degrees and over a length of at least several centimeters; and/or using a tubular pull string assembly for said pulling, which tubular pull string assembly comprises a tubular string provided with at least one flow port in the vicinity of the expansion mandrel through which fluid is permitted to flow from the exterior to the interior of the tubular string.

In accordance with further aspects of the invention, there is furthermore provided a system for expanding at least an upper section of a well liner configured within a lower section of a previously installed liner, the system comprising:

an expansion mandrel;

a tubular pull string assembly that is connected to the expansion mandrel; and a tail section provided on the expansion mandrel, said tail section having a streamlined inwardly tapered outer surface that intersects a longitudinal axis of the expansion mandrel at a sharp angle which is less than 20 degrees and over a length of at least several centimeters; and/or the tubular pull string assembly comprises a tubular string provided with at least one flow port in the vicinity of the expansion mandrel through which fluid is permitted to flow from the exterior to the interior of the tubular string.

In accordance with still further aspects of the invention, there is provided an expansion mandrel for expanding of a well liner inserted at least partially inside a previously installed liner, said expansion mandrel comprising:

a pull direction side;

a tail section on a side of the expansion mandrel opposite from the pull direction side, said tail section having a streamlined inwardly tapered outer surface that intersects a longitudinal axis of the expansion mandrel at a sharp angle which is less than 20 degrees and over a length of at least several centimeters.

The expansion mandrel and/or the method of expanding at least an upper section of a well liner configured within a lower section of a previously installed liner and/or the system for expanding at least an upper section of a well liner configured within a lower section of a previously installed liner may each have a reduced swab pressure generated during pop out of the expansion mandrel from the area of overlap between the upper section of the well liner expanded by the expansion mandrel and the lower section of the previously installed liner.

These and other features, embodiments and advantages of the prosed method and system are described in the accompanying claims, abstract and the following detailed description of non-limiting embodiments depicted in the accompanying drawings, in which description reference numerals are used which refer to corresponding reference numerals that are depicted in the drawings.

Similar reference numerals in different figures denote the same or similar objects. Objects and other features depicted in the figures and/or described in this specification, abstract and/or claims may be combined in different ways by a person skilled in the art.

DETAILED DESCRIPTION OF THE DEPICTED EMBODIMENTS

The current disclosure generally relates to systems and methods for reducing swab pressure generated behind a well liner expansion cone.

Figure 1:
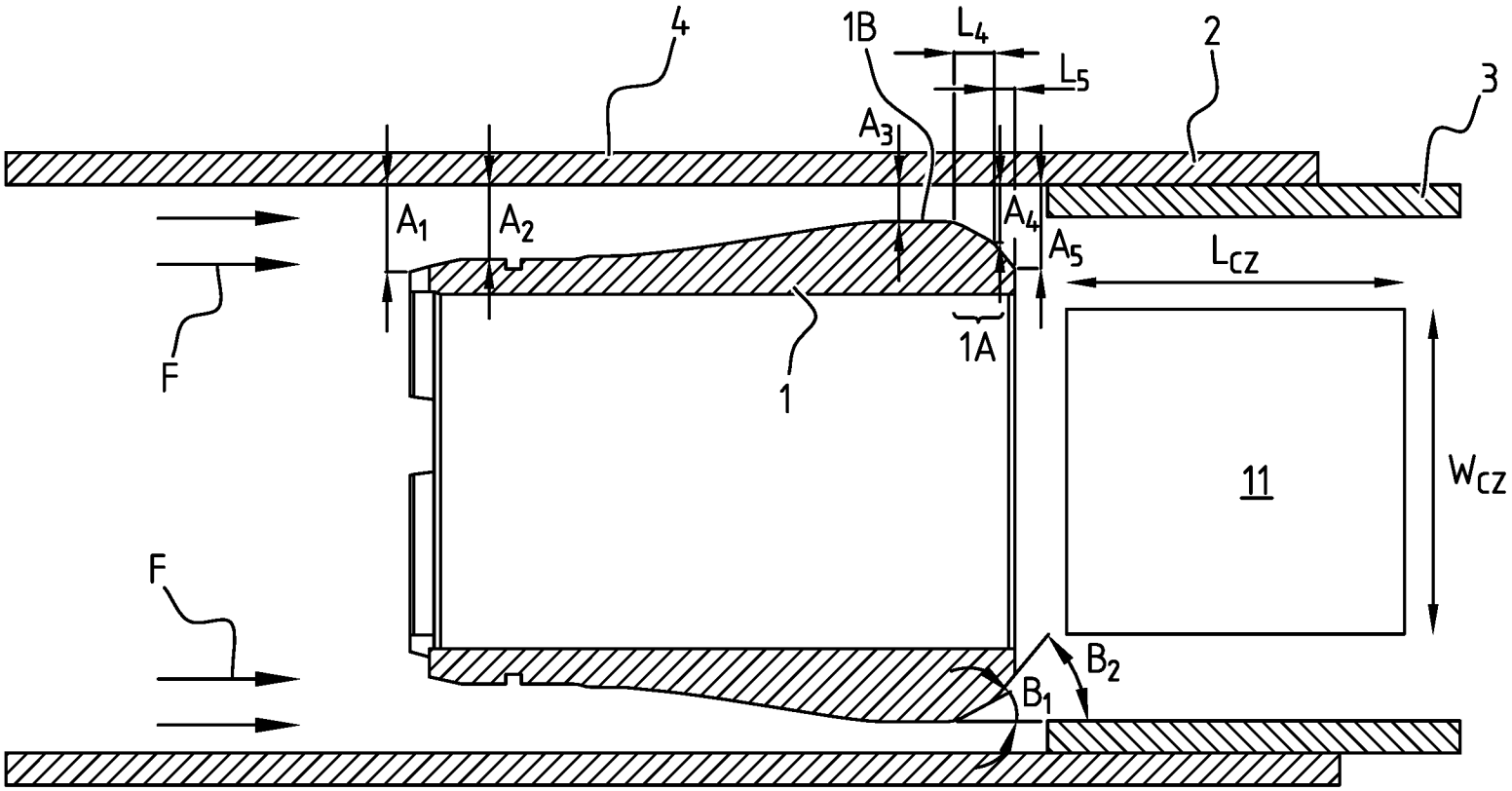
FIG. 1 is a longitudinal sectional view of a prior art expansion cone after popping out from an area of liner overlap.
Figure 2:
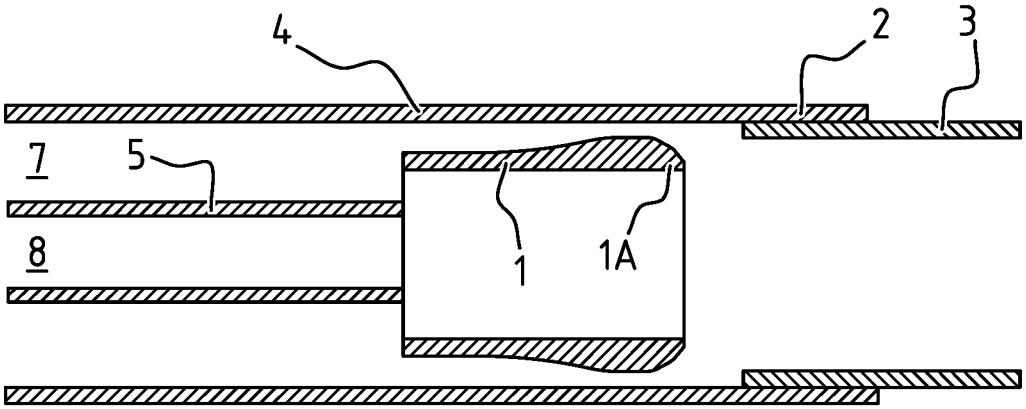
FIG. 2 is a longitudinal sectional view of the prior art cone of FIG. 1 connected to a drill string.

FIGS. 1 and 2 show a prior art expansion cone 1, also known as an expansion mandrel, known from US 2015/247388 A1, after having popped out from an area of overlap 2 between an expanded lower liner section 3 and an earlier installed upper liner section 4. The expansion cone 1 comprises a gauge section 1B, which is a section of the expansion cone 1 that has the largest diameter of the expansion cone 1, i.e. larger diameter than in any other section of the expansion cone 1. The gauge section 1B may be a cylindrical section extending over a certain gauge length in the expansion cone 1. Directly adjacent to the gauge section 1B, the gauge section 1B transitions into a tail section 1A, which begins where the diameter starts to reduce behind the gauge section 1B. The prior art expansion cone 1 has a relatively short tail section 1A. FIG. 1 also illustrates the fluid flow F around the cone 1, the cross-sectional areas that the fluid flow F passes through and a fluid recirculation zone 11 having a length $L_{cz}$ and width $W_{cz}$ behind the cone 1, in which the fluid pressure is significantly reduced when the cone pops out of the area of liner overlap 2.

Figure 3:
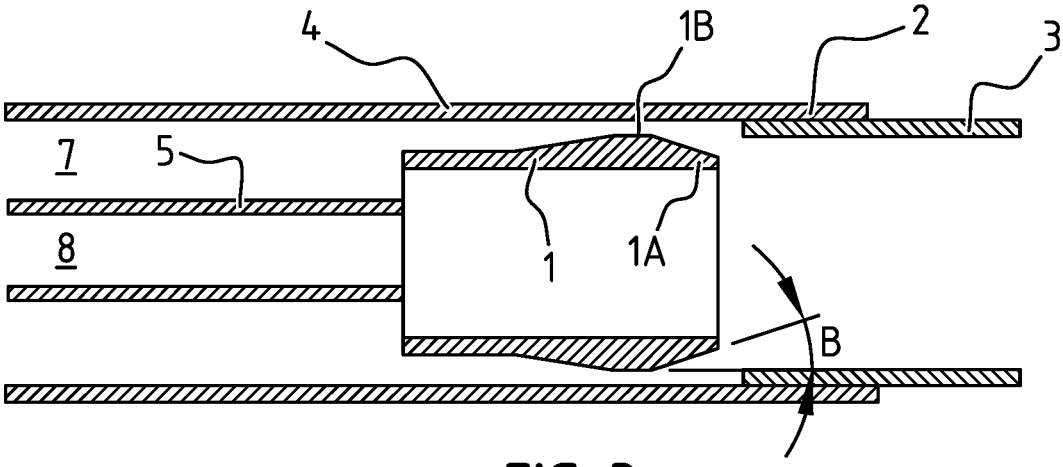
FIG. 3 is a longitudinal sectional view of an expansion cone with an adjusted tail section.

Liner collapse when the expansion cone 1 pops out of the area of overlap 2 may be mitigated by reducing swab pressure. Swab pressure reduction may be accomplished by application of at least one of the following two options:

(1) decreasing the pressure loss of fluid flowing around the cone 1; and (2) increasing the fluid flow through the drill pipe 5 to a region behind the cone, as illustrated in FIGS. 2 and 3.

The methods and systems disclosed herein generally may reduce swab pressure generated during pop out of an expansion mandrel from an area of overlap between an upper section of a well liner expanded by the expansion mandrel and a lower section of a previously installed liner.

FIG. 3 illustrates that the first option (1) can be accomplished by streamlining the tail section of the cone 1, for example by providing the cone 1 with a tapered tail section 1A, which behaves like a diffuser transforming the kinetic energy into potential energy. The tail section 1A is formed by a part of the expansion mandrel directly adjacent to and behind the gauge section of the expansion mandrel.

Figure 4:
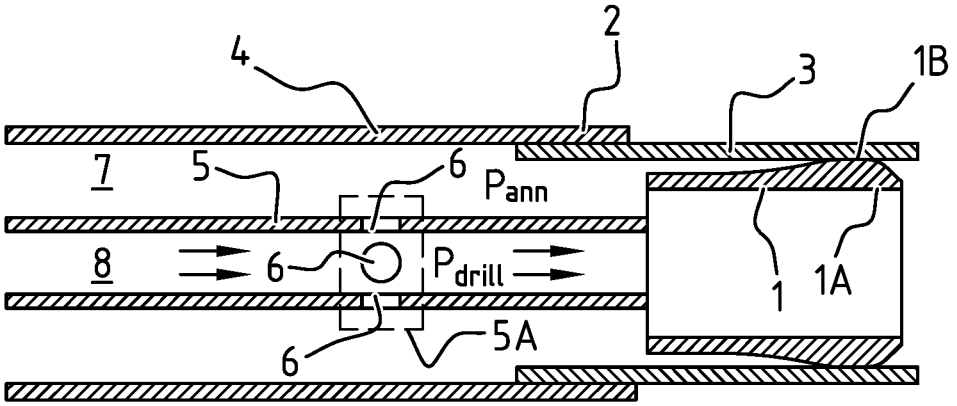
FIG. 4 is a longitudinal sectional view of a cone connected to a drill string which is equipped with flow ports.
Figure 5:
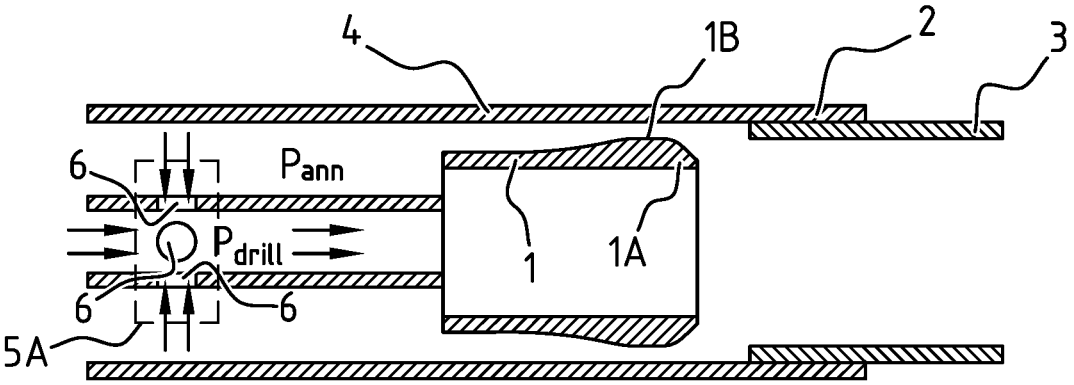
FIG. 5 is a longitudinal sectional view of the cone connected to the drill string of FIG. 4 after cone pops out from the area of liner overlap.

FIGS. 4 and 5 illustrate that the second option (2) can be accomplished by installation of a drill string sub 5A with flow ports 6 that open before the cone 1 pops out of top of the overlap section 2. The drill pipe 5 extends through the cone 1 and debouches in the region behind the cone 1. Flow ports can be applied in combination with the adjusted tail section, or instead of the adjusted tail section. FIG. 5 shows the system with flow ports 6 open. When the flow ports 6 open, there is no fluid flow through the flow ports 6 due to equal pressure in the exterior 7 and interior 8 of the drill pipe 5. When the cone 1 pops out a surge pressure propagates upward in the exterior 7 of the drill pipe 5. The difference in fluid pressure between exterior 7 and interior 8 of the drill pipe 5 allows additional fluid flow to the recirculation zone below the cone 1 through the interior 8 of the drill pipe 5. FIGS. 4 and 5 also illustrate that the flow ports 6 are sub installed in the drill string sub 5A just above the cone 1.

The flow ports 6 are believed to be very effective at reducing the swab pressure, but can cause an undesired mechanical weakness in the drill string. Hence, if adjustment of the tail section suffices to mitigate the negative effects of the swab pressure then it may be preferred to rely on the tail section adjustment alone without providing flow ports.

It will be understood that that key features of the method described herein include one or more of:

pulling the expansion mandrel 1 up through the area of overlap 2 using of a tubular pull string assembly 5,5A that comprises in the vicinity of the mandrel at least one flow port) through which fluid is permitted to flow from the exterior 7 to the interior 8 of the tubular pull string assembly 5,5A during pop out of the expansion mandrel 1; and providing the expansion mandrel 1 with a streamlined tail section 1A having an inwardly tapered outer surface 11 that intersects a longitudinal axis of the mandrel 1 at a sharp angle which is less than 20 degrees and over a length of at least several centimeters.

Assuming the expansion mandrel 1 has a circular symmetric geometry about the longitudinal axis, the angle corresponds to the angle seen in longitudinal section such as illustrated as B1 and B2 in FIG. 1. The length of the tail section is defined as the distance in longitudinal direction between where the gauge section 1B transitions into the tail section 1A and the first time that the angle reaches 20 degrees. This can coincide with the distal extremity of the expansion mandrel 1. The tail section may comprise a range of angles, such as B1 and B2. Preferably, B1≤B2. In case of more than two angles, the angles may consecutively increase at larger distances away from the gauge section 1B towards the distal extremity of the expansion mandrel 1. In certain embodiments, as illustrated in FIG. 3, B1 may be equal to B2, in which case the sharp angle is characterized by angle B.

Analytical calculations and Computational Fluid Dynamics (CFD) simulations have been performed and confirm that, using the method proposed herein, the swab pressure generated in the recirculation zone below the cone 1 when the cone 1 pops out of the top of the expanded lower liner 3 is decreased significantly without contradicting the concept of Mono-Diameter (MOD) well or facing the risk of fracturing the surrounding formation, or facing difficulties of drilling a clad plug at the bottom of the expanded lower liner 3.

The pressure drop in flow passing through the clearance between the cone 1 and the upper host pipe 4 is a component of the swab pressure. This component is around 30% of the generated swab pressure during cone pop out. The swab pressure decreases by lowering the pressure drop. It is observed that only the cross-sectional areas (A4, A5 shown in FIG. 1) of fluid flow between the tail 1A of the cone 1 and host pipe 4 can be adjusted because they don't influence the expansion process. The two cross-sectional areas are a function of parameters B1, B2, L4 and L5. Calculations indicate that minimizing A4 and A5 to become equal to A3 cannot lead to a minimum pressure drop because an increase in fluid velocity can occur at the tail 1A of cone 1. By this an increase in recirculation length occurs which affects the pressure drop.

Therefore, a further study has been performed with the aforementioned parameters to reach an optimum solution with a minimum pressure drop.

The study indicates that an optimum solution is found with B1 and B2 between 9 and 13 degrees and $L4/D_{cone}$=0.10-0.12, $L5/D_{cone}$=0.40-0.46, wherein $D_{cone}$ is the largest diameter of the expansion cone 1.

A numerical model was built to calculate the swab pressure generated when the cone 1 pops out of the overlap section 2.

Figure 6:
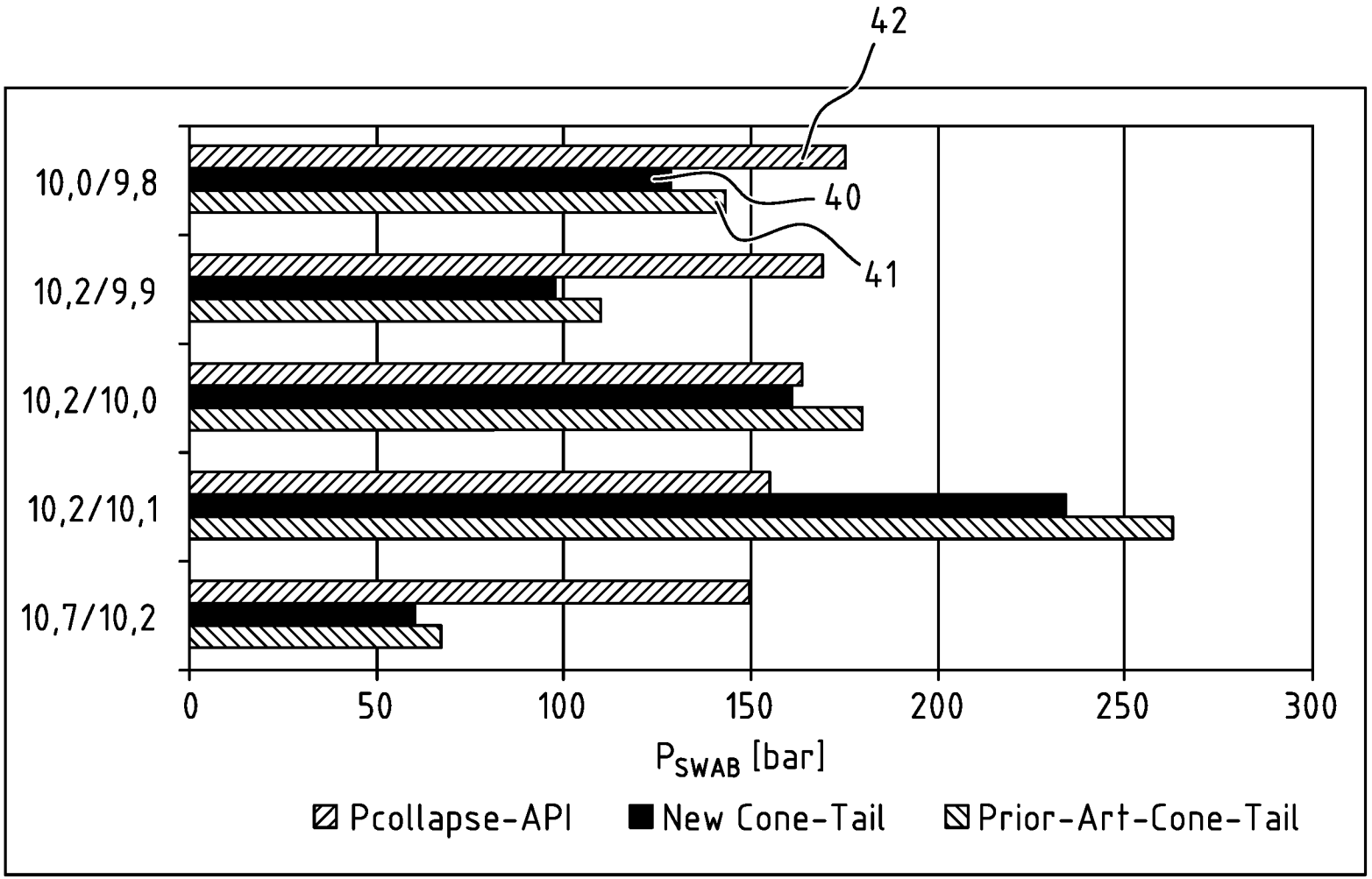
FIG. 6 is graph showing calculations of swab pressure generated by the prior art cone and the cone having the adjusted tail section.

In FIG. 6, the calculated swab pressure generated 41 ($P_{swab}$ in bar) with the prior art cone tail shown in FIGS. 1 and 2 and the calculated swab pressure generated 40 ($P_{swab}$ in bar) with the adjusted (streamlined) cone tail (1A) as shown in FIG. 3 are plotted at different cases where different inner diameter of host pipe 4 and largest cone diameter are used (shown as 10.0/9.8 . . . 10.7/10.2 ratios at the left side of the graph). In addition, the collapse pressure 42 (in bar) of the expanded liner 3 is calculated according to API, with the assumption of uniform thickness and outer diameter and plotted in the same figure for each case to provide an indication whether there may be a tendency to collapse the expanded liner 3 or not.

The results plotted in FIG. 6 confirm that the risk of collapse of the expanded liner 3 is reduced significantly by adjusting the cone tail as described herein. The results indicate that flow ports as described above may be necessary (instead or in addition to the adjusted tail section) for cases where the inner diameter of host pipe 4 and largest cone diameter differ less than a certain threshold amount, for example less than 0.3 inch (76 mm). The method, system and/or any products created using the method and/or system as described herein, are well adapted to attain the ends and advantages mentioned as well as those that are inherent therein.

Optionally the at least one flow port is arranged at a distance of less than 5 meters from the expansion mandrel and comprises a valve that is opened shortly before the expansion cone pops out of the area of overlap.

Preferably, the sharp angle may be less than 15 degrees and/or the streamlined tail section may have a length of at least 5 cm. The tail section may be configured as a diffuser, which converts kinetic energy of the fluid around the tail section of the expansion mandrel into static pressure and thereby reduces the pressure drop in the fluid when the expansion mandrel accelerates during pop out from the area of overlap.

The contents of US 2015/247388 A1 are fully incorporated herein, by reference.

The particular embodiments disclosed above are illustrative only, as the present invention may be modified, combined and/or practiced in different but equivalent manners apparent to those skilled in the art having the benefit of the teachings herein.

Furthermore, no limitations are intended to the details of construction or design herein shown, other than as described in the claims below.

It is therefore evident that the particular illustrative embodiments disclosed above may be altered, combined and/or modified and all such variations are considered within the scope of the present invention as defined in the accompanying claims.

While any methods, systems and/or products embodying the invention are described in terms of "comprising," "containing," or "including" various described features and/or steps, they can also "consist essentially of" or "consist of" the various described features and steps.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

The claims have been presented including independent claims and dependent claims. The dependent claims each are singly dependent on one of the precedings claims. However, any multiple dependency of claims, whereby any one of the dependent claims depends on an independent claim and any combination of other single or multiple dependent claims, is considered to be included in the present disclosure. Also, the terms in the claims have their plain, ordinary meaning unless otherwise explicitly and clearly defined by the patentee.

Moreover, the indefinite articles "a" or "an", as used in the claims, are defined herein to mean one or more than one of the element that it introduces.

If there is any conflict in the usages of a word or term in this specification and one or more patent or other documents that may be cited herein by reference, the definitions that are consistent with this specification should be adopted.

We claim:

1. A method of expanding at least an upper section of a well liner configured within a lower section of a previously installed liner, the method comprising:

pulling an expansion mandrel up through the well liner, in an area of overlap between the well liner and the previously installed liner, using a tubular pull string assembly that comprises a tubular string provided with at least one flow port in the vicinity of the expansion mandrel through which fluid is permitted to flow from the exterior to the interior of the tubular string, which flow port is open when the expansion mandrel reaches, and pops out of, a top of the area of overlap.

2. The method of claim 1, wherein the at least one flow port is arranged at a distance of less than 5 meters from the expansion mandrel.

3. The method of claim 1, wherein the at least one flow port comprises a valve that is opened shortly before the expansion cone pops out of the area of overlap.

4. The method of claim 1, further comprising:

providing the expansion mandrel with a streamlined tail section having an inwardly tapered outer surface that intersects a longitudinal axis of the expansion mandrel at a sharp angle which is less than 20 degrees over a length of at least 5 centimeters (cm).

5. The method of claim 4, wherein the sharp angle is less than 15 degrees.

6. The method of claim 1, wherein the expansion mandrel comprises a gauge section having a gauge diameter Dcone, followed by a tail section having a streamlined inwardly tapered outer surface that intersects a longitudinal axis of the expansion mandrel at a sharp angle which is less than 20 degrees and has a length of at least 5 centimeters (cm), wherein said tail section comprises two consecutive tapered zones of the angles of which, both within a range of between 9 and 13 degrees, consecutively increase at larger distances away from the gauge section, over respective lengths L4 and L5, wherein a ratio L4/Dcone is in a range of from 0.10 to 0.12 and a ratio L5/Dcone is in a range of from 0.40 to 0.46.

7. A method of expanding at least an upper section of a well liner configured within a lower section of a previously installed liner, the method comprising:

providing an expansion mandrel with a gauge section having a gauge diameter Dcone, and followed by a streamlined tail section having an inwardly tapered outer surface that intersects a longitudinal axis of the expansion mandrel at a sharp angle which is less than 20 degrees and over a length of at least 5 centimeters (cm);

pulling the expansion mandrel up through the well liner, in an area of overlap between the well liner and the previously installed liner whereby the expansion mandrel reaches, and pops out of, a top of the area of overlap;

wherein said tail section comprises two consecutive tapered zones of the angles of which, both within a range of between 9 and 13 degrees, consecutively increase at larger distances away from the gauge section, over respective lengths L4 and L5, wherein a ratio L4/Dcone is in a range of from 0.10 to 0.12 and a ratio L5/Dcone is in a range of from 0.40 to 0.46.

8. The method of claim 7, wherein the tail section acts as a diffuser, which converts kinetic energy of the fluid around the tail section of the expansion mandrel into static pressure and thereby reduces the pressure drop in the fluid when the expansion mandrel accelerates during pop out from the area of overlap.

9. A system for expanding at least an upper section of a well liner configured within a lower section of a previously installed liner, the system comprising:

an expansion mandrel with a gauge section having a gauge diameter Dcone, and followed by a tail section having a streamlined inwardly tapered outer surface that intersects a longitudinal axis of the expansion mandrel at a sharp angle which is less than 20 degrees and has a length of at least 5 centimeters (cm);

a tubular pull string assembly that is connected to the expansion mandrel; and wherein said tail section comprises two consecutive tapered zones of the angles of which, both within a range of between 9 and 13 degrees, consecutively increase at larger distances away from the gauge section, over respective lengths L4 and L5, wherein a ratio L4/Dcone is in a range of from 0.10 to 0.12 and a ratio L5/Dcone is in a range of from 0.40 to 0.46.

10. The system of claim 9, wherein the sharp angle is less than 15 degrees.

11. The system of claim 9, wherein said tubular pull string assembly comprising a tubular string provided with at least one flow port in the vicinity of the expansion mandrel through which fluid is permitted to flow from the exterior to the interior of the tubular string.

12. The system of claim 11, wherein the at least one flow port is arranged at a distance of less than 5 meters from the expansion mandrel.

13. The system of claim 11, wherein the at least one flow port comprises a valve.

14. An expansion mandrel for expanding of a well liner inserted at least partially inside a previously installed liner, said expansion mandrel comprising:

a pull direction side;

a gauge section having a gauge diameter Dcone;

a tail section on a side of the gauge section opposite from the pull direction side, said tail section having a streamlined inwardly tapered outer surface that intersects a longitudinal axis of the expansion mandrel at a sharp angle which is less than 20 degrees over a length of at least 5 centimeters (cm) wherein said tail section comprises two consecutive tapered zones of the angles of which, both within a range of between 9 and 13 degrees, consecutively increase at larger distances away from the gauge section, over respective lengths L4 and L5, wherein a ratio L4/Dcone is in a range of from 0.10 to 0.12 and a ratio L5/Dcone is in a range of from 0.40 to 0.46.

* * * * *